US010004312B2

(12) United States Patent
Drew et al.

(10) Patent No.: US 10,004,312 B2
(45) Date of Patent: Jun. 26, 2018

(54) STRETCH CARRY STRAP ASSEMBLY

(71) Applicant: Target Brands, Inc., Minneapolis, MN (US)

(72) Inventors: Jason V. Drew, Minneapolis, MN (US); Christopher E. Svensrud, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 666 days.

(21) Appl. No.: 14/512,641

(22) Filed: Oct. 13, 2014

(65) Prior Publication Data

US 2016/0100662 A1 Apr. 14, 2016

(51) Int. Cl.
*A45C 13/30* (2006.01)
*A45C 13/28* (2006.01)

(52) U.S. Cl.
CPC ..... *A45C 13/30* (2013.01); *A45C 13/28* (2013.01); *A45C 2013/306* (2013.01)

(58) Field of Classification Search
CPC ..... A45C 5/14; A45C 13/262; A45C 5/146; A45C 13/385; A45C 3/004
USPC ..... 190/18 A, 107, 108, 115; 119/771, 792, 119/797, 798, 109, 106; 16/114.1, 50; 24/68 R; 473/415; 206/579; 482/121
See application file for complete search history.

(56) References Cited

U.S. PATENT DOCUMENTS 3,275,336 A 9/1966 Warner, Jr.
3,982,613 A * 9/1976 Wood ..... A45C 13/262 190/116
4,134,480 A * 1/1979 Davis ..... A45C 13/26 16/405
4,759,431 A 7/1988 King et al.
5,788,032 A 8/1998 Krulik
5,890,571 A 4/1999 Sadow
5,897,039 A 4/1999 Swenke
5,927,450 A 7/1999 Sadow
5,950,893 A 9/1999 Heggeland
(Continued)

FOREIGN PATENT DOCUMENTS

CH 702207 A2 * 5/2011 ..... A45C 13/30
GB 2306877 A * 5/1997 ..... A45C 13/30

OTHER PUBLICATIONS

Poetic, "Poetic SlimBook Case for iPad Mini," http://www.yourpoetic.com/blog/45/poetic-slimbook-case-for-ipad-mini, at least as early as Oct. 2013, 1 page.
(Continued)

*Primary Examiner* — Fenn C Mathew
*Assistant Examiner* — Cynthia Collado
(74) *Attorney, Agent, or Firm* — Leanne Taveggia Farrell; Westman, Champlin & Koehler, P.A.

(57) ABSTRACT

A bag includes a strap assembly having a first end, a second end, a pair of governing regions and a main region located between each of the pair of governing regions. The strap assembly includes a layer of elastic fabric and a layer of non-elastic fabric coupled to an upper surface of the layer of elastic fabric. When the strap assembly is in a relaxed position, the pair of governing regions include a gap between the layer of elastic fabric and the layer of non-elastic fabric. When the strap assembly is in a stretched position, the layer of non-elastic fabric governs how much the layer of elastic fabric is stretched in the pair of governing regions.

13 Claims, 9 Drawing Sheets

(56) References Cited

U.S. PATENT DOCUMENTS

| | | | | |
|---|---|---|---|---|
| 6,536,568 | B1 | 3/2003 | Tong | |
| 7,318,507 | B2 | 1/2008 | Fenton et al. | |
| 7,775,334 | B2 | 8/2010 | Drew et al. | |
| 8,015,669 | B2 | 9/2011 | Huang et al. | |
| 8,123,008 | B2 | 2/2012 | Thomas | |
| 8,245,825 | B2 | 8/2012 | Yoneno et al. | |
| 2003/0038008 | A1 | 2/2003 | Han | |
| 2006/0260893 | A1* | 11/2006 | Drew | A45C 5/14 190/108 |
| 2010/0300906 | A1* | 12/2010 | Moore | A45C 13/02 206/315.1 |
| 2011/0139560 | A1 | 6/2011 | Via | |
| 2012/0295776 | A1* | 11/2012 | Chen | A63B 21/0442 482/121 |

OTHER PUBLICATIONS

Funny Fur, "Sleepypod Atom Pet Carriers," http://www.funnyfur.com/sleepypod-atom-pet-carriers.aspx, at least as early as Oct. 2013, 1 page.

* cited by examiner

STRETCH CARRY STRAP ASSEMBLY

BACKGROUND

Suitcases, carrying cases or bags are portable and are commonly used to carry personal items and/or business-related items when traveling. Suitcases come in different sizes and configurations with many suitcases having telescoping handles that can be used to roll the suitcase instead of carrying the suitcase. There are suitcases designed specifically for adult use and suitcases designed specifically for child use.

The discussion above is merely provided for general background information and is not intended to be used as an aid in determining the scope of the claimed subject matter.

SUMMARY

A bag includes a strap assembly having a first end, a second end, a pair of governing regions and a main region located between each of the pair of governing regions. The strap assembly includes a layer of elastic fabric and a layer of non-elastic fabric coupled to the layer of elastic fabric. When the strap assembly is in a relaxed position, the pair of governing regions include a gap between the layer of elastic fabric and the layer of non-elastic fabric. When the strap assembly is in a stretched position, the layer of non-elastic fabric limits how far the layer of elastic fabric stretches in the pair of governing regions.

A bag includes an exterior surface and at least one stretch carry strap assembly having a first end and a second end. The stretch carry strap assembly is coupled to the exterior surface and includes an elastic strap and a non-elastic webbing strap coupled to the elastic strap at spaced apart areas of attachment. In a first section of the stretch carry strap assembly, the elastic strap has a relaxed length and a stretched length and the non-elastic webbing strap has a length. The length of the non-elastic webbing strap in the first section is greater than the relaxed length of the elastic strap in the first section and is substantially similar to the stretched length of the elastic strap in the first section. In a second section of the stretch carry strap assembly, the elastic strap has a length and the non-elastic webbing strap has a length that is substantially similar to the length of the elastic strap in the second section. In a third section of the stretch carry strap assembly, the elastic strap has a relaxed length and a stretched length and the non-elastic webbing strap has a length. The length of the non-elastic webbing strap in the third section is greater than the relaxed length of the elastic strap in the third section and substantially similar to the stretched length of the elastic strap in the third section.

A method of towing a second suitcase on a first suitcase is also provided. A telescoping handle connected to at least one telescoping tube on the first suitcase is extended so that the first suitcase can be wheeled across a floor. A stretch carry strap assembly that is attached to an exterior surface of the second suitcase is pulled away from the exterior surface of the second suitcase from a relaxed position into a stretched position. The stretch carry strap assembly while in the stretched position is slid over and around the at least one telescoping tube connected to the telescoping handle on the first suitcase. The stretch carry strap assembly includes a non-elastic strap assembled to an elastic strap such that the non-elastic strap governs how far the elastic strap can be pulled away from the exterior surface of the second suitcase in the stretched position. The second suitcase is then towed on the first suitcase.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

At least one stretch carry strap assembly is attached to an exterior surface of a bag, such as a suitcase, and has a relaxed position and a stretched position. The at least one stretch carry strap assembly includes an elastic strap and a non-elastic webbing strap coupled to a surface of the elastic strap. The webbing strap governs how far the elastic strap can stretch. In this way, the stretch carry strap assembly can be used to slide over a telescoping handle on another bag for towing without the elastic strap stretching too far and causing the bag with the stretch carry strap assembly to slide off the bag that it is being towed by.

Figure 1:
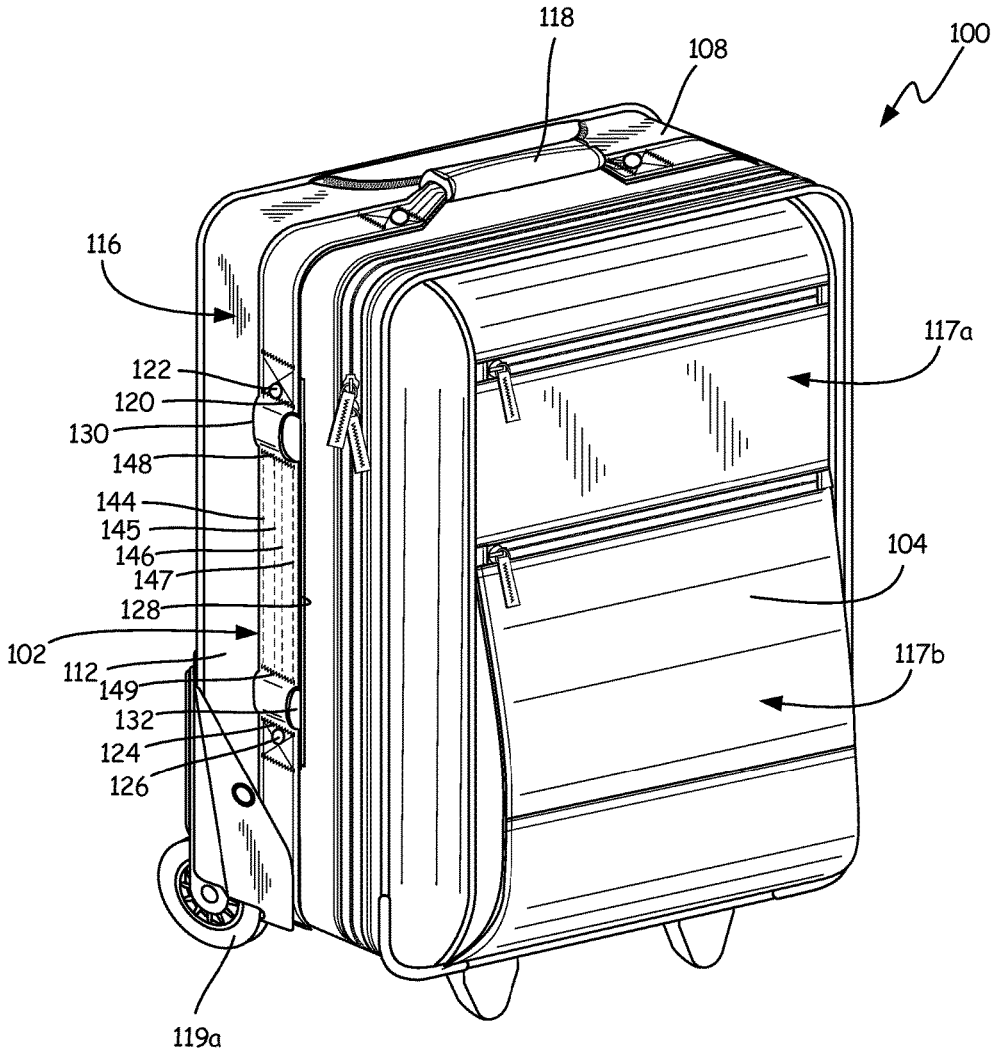
FIG. 1 is a perspective view of a bag showing a stretch carry strap assembly in a relaxed position according to one embodiment.
Figure 2:
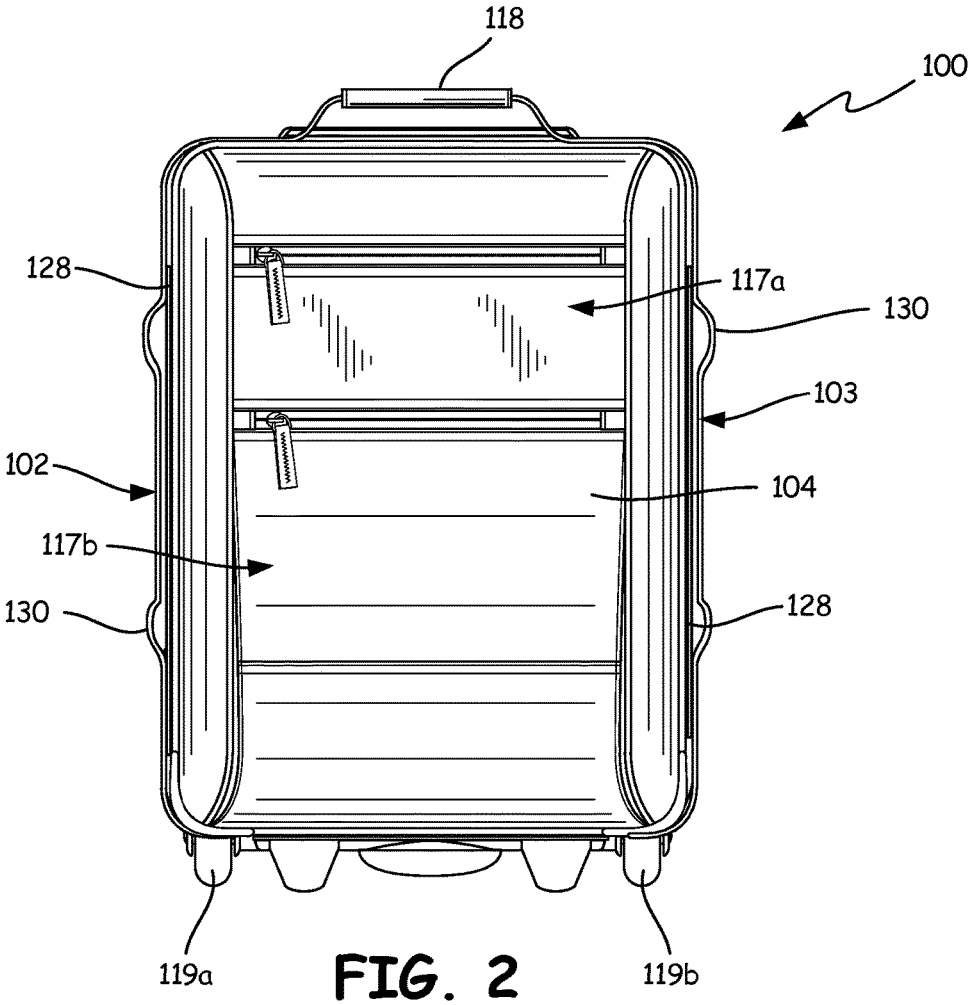
FIG. 2 is a front view of FIG. 1.
Figure 3:
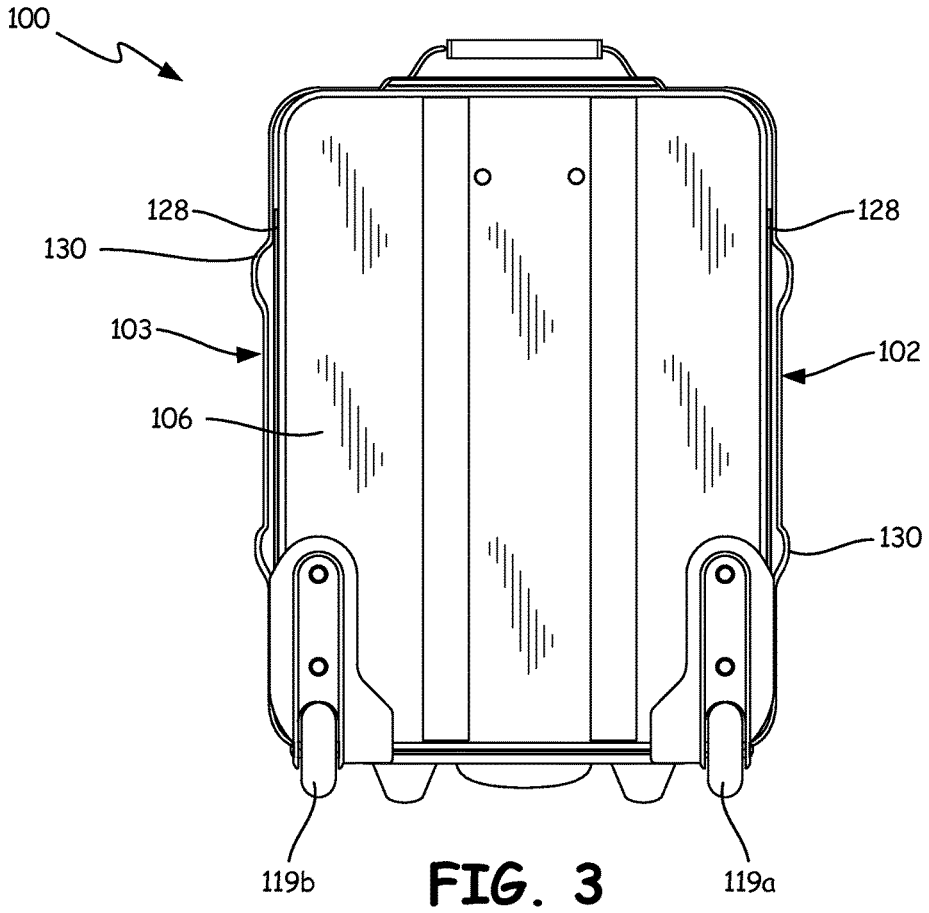
FIG. 3 is a back view of FIG. 1.
Figure 4:
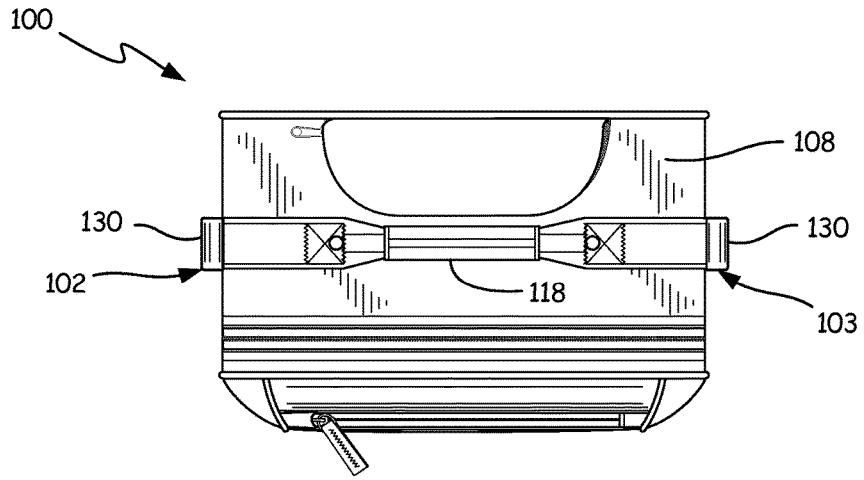
FIG. 4 is a top view of FIG. 1.
Figure 5:
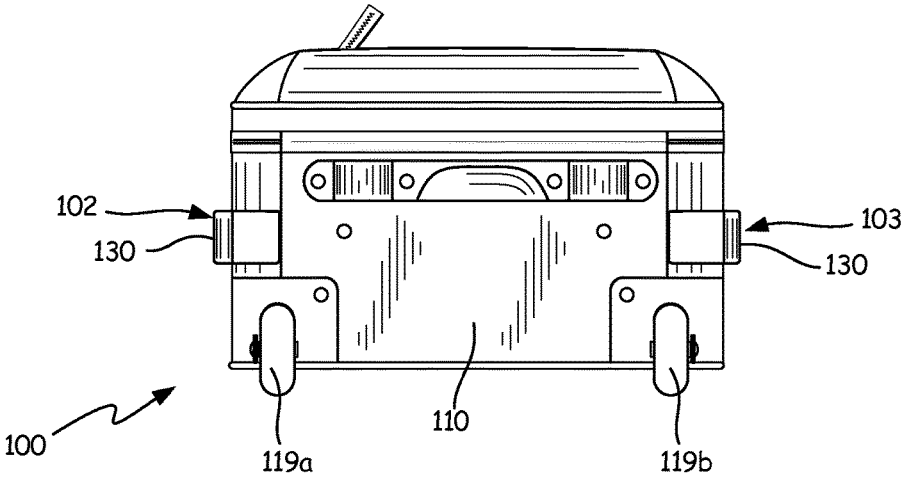
FIG. 5 is a bottom view of FIG. 1.
Figure 6:
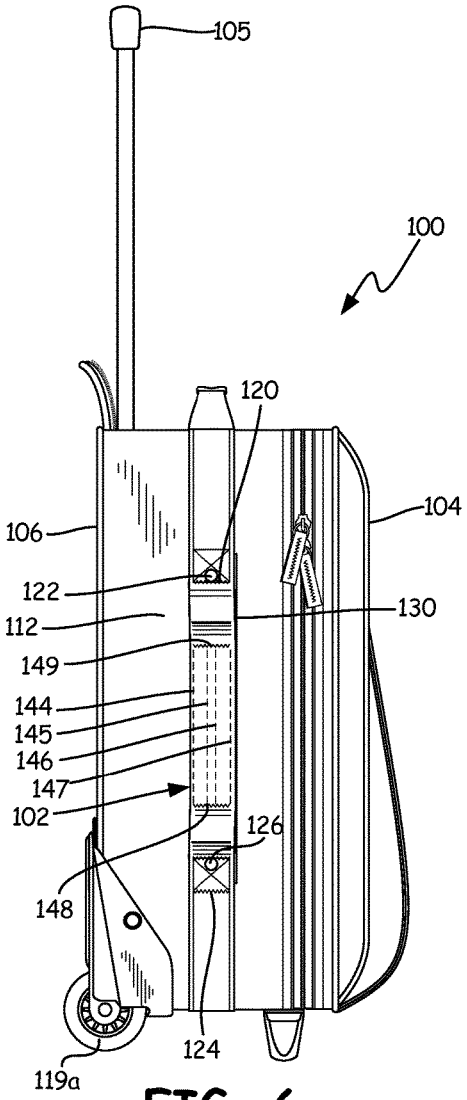
FIG. 6 is a left side view of FIG. 1 with a telescoping handle extended.
Figure 7:
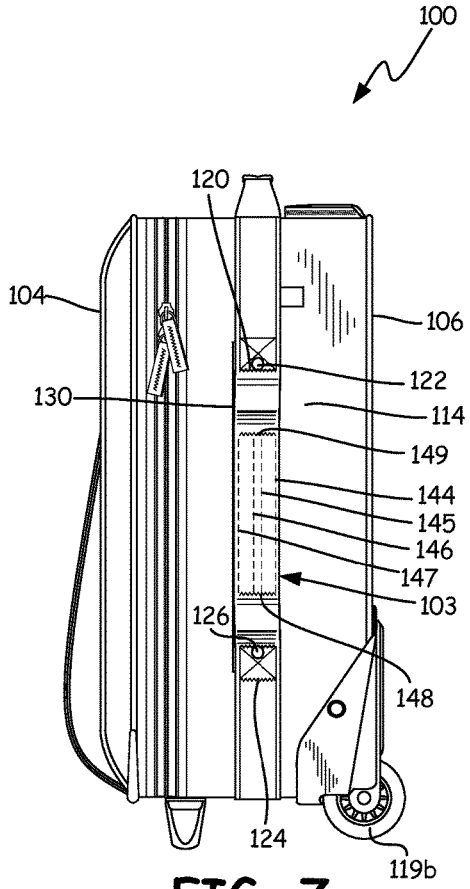
FIG. 7 is a right side view of FIG. 1 showing an additional stretch carry strap assembly attached to the bag in a relaxed position.

FIG. 1 is a perspective view of a bag or suitcase 100 having a stretch carry strap assembly or handle 102 in a relaxed position in accordance with one embodiment. FIG. 2 is a front view of bag 100, FIG. 3 is a back view of bag 100, FIG. 4 is a top view of bag 100, FIG. 5 is a bottom view of bag 100, FIG. 6 is a left side view of bag 100 with a telescoping handle 105 in an extended position and FIG. 7 is a right side view of bag 100.

Bag 100 includes a front 104, a back 106, a top 108, a bottom 110, a left side 112 and a right side 114. Together, front 104, back 106, top 108, bottom 110, left side 112 and right side 114 define an exterior or outer surface 116 of bag 100. Bag 100 includes standard features of a rolling suitcase used by travelers. In particular, front 104 of bag 100 includes exterior pockets 117*a* and 117*b* having zip closures, top 108 of bag 100 includes a standard handle 118 sewed to exterior surface 116 and bottom 110 includes a pair of wheels 119*a* and 119*b*.

Figure 8:
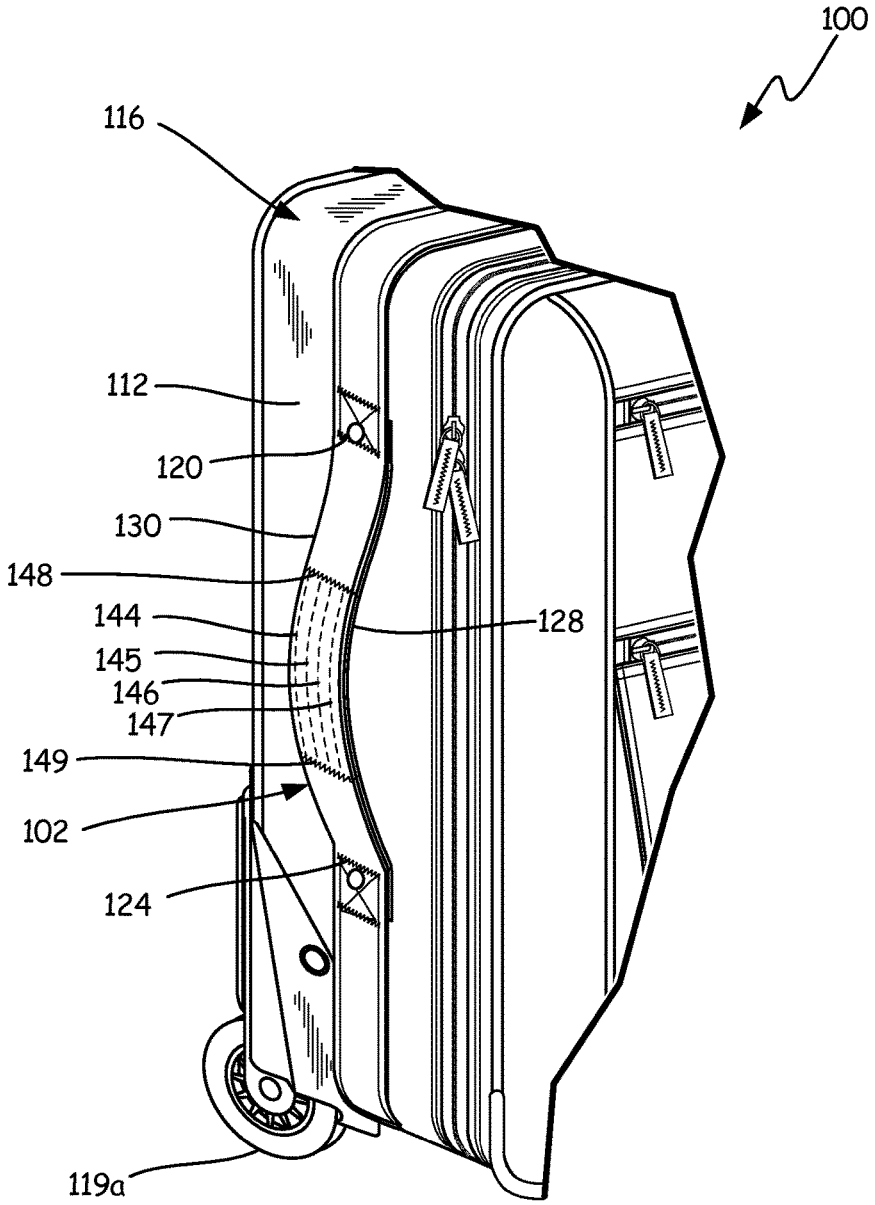
FIG. 8 is a partial perspective view of the bag in FIG. 1 with the stretch carry strap assembly in a stretched position according to one embodiment.

Bag 100 includes at least one stretch carry strap assembly 102 attached to the left side 112 or right side 114. In the embodiment illustrated in FIGS. 1-7, bag 100 includes a first stretch carry strap assembly 102 attached to exterior surface 116 on left side 112 and a second stretch carry strap assembly 103 attached to exterior surface 116 on right side 114. First and second stretch carry strap assemblies 102 and 103 are substantially identical and each includes a first end 120 and a second end 124. First end 120 is attached to exterior surface 116 by a rivet 122 and second end 124 is attached to exterior surface 116 by a rivet 126. However, first end 120 and second end 124 can be attached to exterior surface 116 in other ways including by bar tack and by stitching. In one embodiment, stretch carry assemblies 102 and 103 can be in relaxed positions as illustrated in FIGS. 1-7 and stretch carry assemblies 102 and 103 can be pulled into stretched positions. FIG. 8 is a partial perspective view of bag 100 with stretch carry strap assembly 102 in a stretched position.

Figure 9:
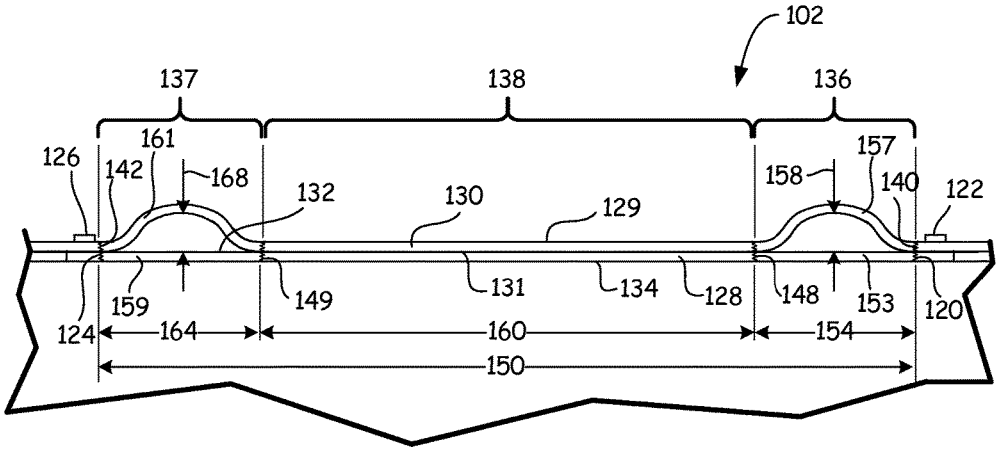
FIG. 9 is an enlarged side view of the stretch carry strap assembly in a relaxed position as shown in FIG. 1.
Figure 10:
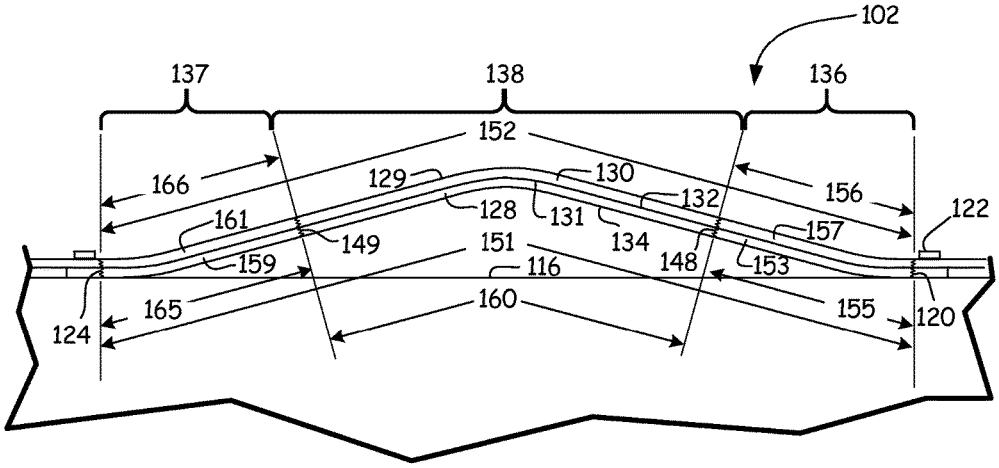
FIG. 10 is an enlarged side view of the stretch carry strap assembly in a stretched position as shown in FIG. 8.

As illustrated in FIGS. 1-8 and as shown in the enlarged side views in FIG. 9 where stretch carry strap assembly 102 is in a relaxed position and in FIG. 10 where stretch carry strap assembly 102 is in a stretched position, in one embodiment, stretch carry strap assembly 102 (and also stretch carry strap assembly 103) includes a layer of elastic fabric or elastic strap 128 and a layer of non-elastic fabric or non-elastic webbing strap 130. The layer of elastic fabric or strap 128 is made of a material that can easily stretch and is capable of resuming its normal size and shape. For example, elastic fabric or strap 128 can be made at least partially with yarns containing rubber. The layer of non-elastic fabric or strap 130 is made of a material that cannot easily stretch. For example, no-elastic fabric can be made with non-elastic yarns.

In one embodiment and as illustrated, elastic strap 128 is attached to a surface of non-elastic webbing strap 130. In particular, elastic strap 128 includes a top or upper surface 132 and a bottom or lower surface 134. Non-elastic webbing strap 130 includes a top or upper surface 129 and a bottom or lower surface 131. As illustrated, lower surface 131 of non-elastic webbing strap is attached to upper surface 132 of elastic strap 128. While in a relaxed position, as illustrated in FIGS. 1-7 and in FIG. 9, lower surface 134 of elastic strap 128 runs along and touches exterior surface 116 of bag 100. However, an upper surface of non-elastic webbing strap can be attached to a lower surface of the elastic strap. In other embodiments, the layer of elastic fabric can be inside a tubular layer of non-elastic fabric.

Elastic strap 128 includes a relaxed length 150 (FIG. 9) that extends from first end 120 to second end 124 of strap assembly 102. Elastic strap 128 also includes a stretched length 151 (FIG. 10) that extends from first end 120 to second end 124. Non-elastic webbing strap 130 includes a length 152 (FIG. 10) regardless of whether stretch carry strap assembly 102 is in a relaxed position or a stretched position. Length 152 of non-elastic webbing strap 130 is greater than relaxed length 150 of elastic strap 128 and is substantially similar to stretched length 151 of elastic strap 128. Stretched length 151 is not the greatest length to which elastic strap 128 can stretch. However, it is the greatest length to which elastic strap 128 can stretch given its coupling to non-elastic webbing strap 130. More specifically, non-elastic webbing strap 130 governs how far elastic strap 128 can stretch and that amount of stretch corresponds with stretch length 151.

With reference to FIGS. 9 and 10, stretch carry strap assembly 102 (and likewise stretch carry strap assembly 103) includes a pair of governing regions or sections 136 and 137 and a main region or section 138 located between each of the pair of governing regions or sections 136 and 137. To define these three regions 136, 137 and 138, non-elastic strap 130 is coupled to elastic strap 128 in spaced apart areas of attachment including a first area of attachment 140 (which also defines first end 120 of strap assembly 102 because rivet 122 is located adjacent to first area of attachment 140), a second area of attachment (denoted by main region 138 where non-elastic strap 130 is coupled to elastic strap 128 along the entirety of main region 138) and a third area of attachment 142 (which also defines second end 124 of strap assembly 102 because rivet 126 is located adjacent to second area of attachment 140).

In the embodiment illustrated in FIGS. 1-10, first, second and third areas of attachment 140, 138 and 142 include areas where lower surface 131 of non-elastic strap 130 are attached to upper surface 132 of elastic strap 128 by stitching. In particular and as illustrated in FIGS. 1 and 6-8, second attachment area or main region 138 is defined between two rows of widthwise stitching 148 and 149 that couple non-elastic strap 130 to elastic strap 128. Second attachment area or main region 138 includes four lengthwise rows of stitching 144, 145, 146 and 147 oriented substantially perpendicular to the two widthwise rows of stitching 148 and 149 to affix non-elastic strap 130 to elastic strap 128 in this central area. Lengthwise rows of stitching 144, 145, 146 and 147 extend from widthwise stitching 148 to widthwise stitching 149, so regardless of whether the stretch carry strap assembly 102 is in a relaxed position or in a stretched position, upper surface 132 of elastic strap 128 in main region 138 is in contact with and fully coupled to a lower surface or bottom surface 131 of non-elastic strap 130 in main region 138. In addition and as illustrated in FIGS. 9 and 10, first area of attachment 140 includes a row of widthwise stitching 120 spaced apart from widthwise stitching 148 and couples non-elastic strap 130 to elastic strap 128. The space between stitching 148 and stitching 120 provides a stretch zone for elastic strap 128. Third area of attachment 142 includes a row of widthwise stitching 124 that is spaced apart from widthwise stitching 149 and couples non-elastic strap 130 to elastic strap 128. The space between stitching 149 and stitching 124 provides another stretch zone for elastic strap 128.

In particular, between first area of attachment 140 and second area of attachment 138 is a first governing region or first section 136 of strap assembly 102. In first governing region or first section 136, elastic strap 128 includes a first portion 153 having a relaxed length 154 (FIG. 9) and a stretched length 155 (FIG. 10). In first governing region or first section 136, non-elastic webbing strap 130 includes a portion 157 having a length 156 (best shown in FIG. 10). Length 156 of non-elastic strap 130 in first section 136 is greater than relaxed length 154 of portion 153 of elastic strap 128 in first section 136 and is substantially similar to stretched length 155 of portion 153 of elastic strap 128 in first section 136. In other words, when stretch carry strap assembly 102 is in a relaxed position as is shown in FIGS. 1-7 and 9, first governing region or first section 136 includes a gap 158 between elastic strap 128 and non-elastic webbing strap 130. When stretch carry strap assembly 102 is in a stretched position as is shown in FIGS. 8 and 10, non-elastic strap 130 limits how far the elastic strap 128 stretches in first governing region or first section 136.

Between widthwise stitching 148 and widthwise stitching 149 is main region or second area of attachment 138 of stretch carry strap assembly 102. As previously described, non-elastic webbing strap 130 in main region 138 is fully attached to elastic strap 128 in main region 138. This means the portion of elastic strap 128 in main region 138 has a substantially a constant length 160 regardless of whether stretch carry strap assembly 102 is in a relaxed position or a stretched position and the portion of non-elastic webbing strap 130 in main region has the same substantially constant length 160. The full attachment of non-elastic webbing strap 130 to elastic strap 128 in main region 138 prevents elastic strap 128 from being further stretched or lengthened beyond the length of non-elastic webbing strap 130 in this region.

Between second area of attachment 138 and third area of attachment 142 is a second governing region or third section 137 of stretch carry strap assembly 102. In second governing region or third section 137, portion 159 of elastic strap 128 has a relaxed length 164 (FIG. 9) and a stretched length 165 (FIG. 10). In second governing region or third section 137, non-elastic webbing strap 130 includes a portion 161 having a length 166 (best shown in FIG. 10). Length 166 of portion 161 of non-elastic webbing strap 130 in third section 137 is greater than relaxed length 164 of portion 159 of elastic strap 128 in third section 137 and is substantially similar to stretched length 165 of portion 159 of elastic strap 128 in third section 137. In other words, when stretch carry strap assembly 102 is in a relaxed position as is shown in FIGS. 1-7 and 9, second governing region or third section 137 includes a gap 168 between elastic strap 128 and non-elastic webbing strap 130. When stretch carry strap assembly 102 is in a stretched position as is shown in FIGS. 8 and 10, non-elastic strap 130 limits how far the elastic strap 128 stretches in second governing region or third section 137.

Figure 11:
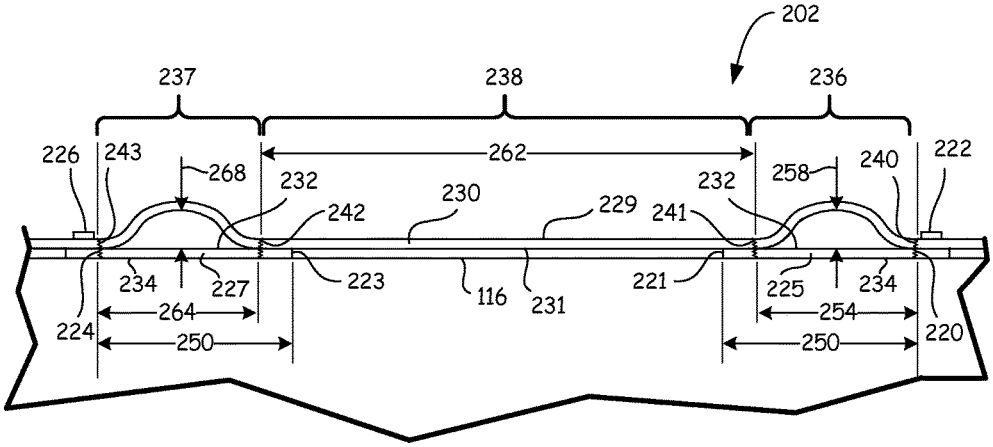
FIG. 11 is an enlarged side view of an alternative embodiment of the stretch carry strap assembly in a relaxed position.
Figure 12:
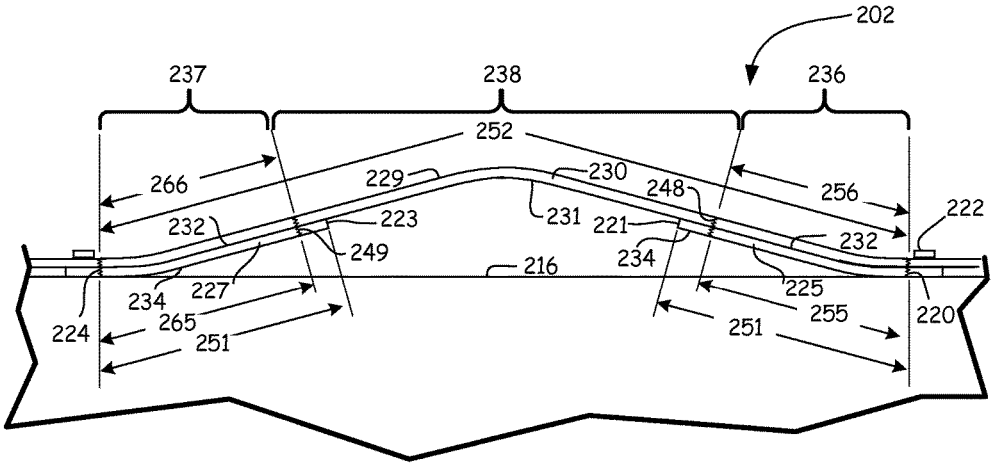
FIG. 12 is an enlarged side view of an alternative embodiment of the stretch carry strap assembly in a stretched position.

FIGS. 11 and 12 illustrate another embodiment of a stretch carry strap assembly 202 that can be attached to first side 112 or second side 114 of bag 100. FIG. 11 is an enlarged side view of stretch carry strap assembly 202 in a relaxed position and FIG. 12 is an enlarged side view of stretch carry strap assembly 202 in a stretched position. Stretch carry strap assembly 202 includes a first end 220 and a second end 224. First end 220 is attached to exterior surface 116 of bag 100 by a rivet 222 and second end 224 is attached to exterior surface 116 of bag 100 by a rivet 226. However, first end 220 and second end 224 can be attached to exterior surface 116 in other ways including by bar tack and stitching. In this embodiment, stretch carry strap assembly 202 includes a layer of elastic material or elastic strap that includes two spaced apart portions 225 and 227 and a layer of non-elastic material or non-elastic webbing strap 230. First and second spaced apart portions 225 and 227 of the elastic layer include top or upper surfaces 232 and bottom or lower surfaces 234. Non-elastic webbing strap 230 includes a top or upper surface 229 and a bottom or lower surface 231. Lower surface 231 of non-elastic webbing strap is attached to upper surfaces 232 of first and second spaced apart portions 225 and 227 of the elastic layer. While in a relaxed position, as illustrated in FIG. 11, lower surface 234 of first and second spaced apart portions 225 and 227 of the elastic layer run along and touch exterior surface 116 of bag 100.

First and second spaced apart portions 225 and 227 of the elastic layer include relaxed lengths 250 (FIG. 11) that extend from first end 220 or second end 224 of stretch carry strap assembly 202 to a terminating end 221 or terminating end 223. First and second spaced apart portions 225 and 227 of the elastic layer also include stretched lengths 251 (FIG. 12) that extend from first end 220 or second end 224 to terminating end 221 and 223. Non-elastic webbing strap 230 includes a length 252 (FIG. 12) regardless if stretch carry strap assembly 202 is in a relaxed position or a stretched position. Stretched lengths 251 of first and second spaced apart portions 225 and 227 are not the greatest lengths to which the first and second spaced apart portions 225 and 227 can stretch. However, lengths 251 are the greatest lengths to which first and second spaced apart portions 225 and 227 can stretch given their coupling to non-elastic webbing strap 230. More specifically, non-elastic webbing strap 230 governs how far first and second spaced apart portions 225 and 227 can stretch.

With reference to FIGS. 11 and 12, stretch carry strap assembly 202 includes a pair of governing regions or section 236 and 237 and a main region or section 238 located between each of the pair of governing regions or sections 236 and 237. To define these three regions 236, 237 and 238, non-elastic strap 230 is coupled to first and second spaced apart portions 225 and 227 of elastic slayer 228 in spaced apart areas of attachment including a first area of attachment 240 (which also defines first end 220 of strap assembly 202 because rivet 222 is located adjacent to first area of attachment 240), a second area of attachment 241, a third area of attachment 242 and a fourth area of attachment 243 (which also defines second end 224 of strap assembly 202 because rivet 226 is located adjacent to second area of attachment 240).

In the embodiment illustrated in FIGS. 11-12, first, second, third and fourth areas of attachment 240, 241, 242 and 243 include areas where lower surface 231 of non-elastic strap 230 is attached to upper surfaces 232 of first and second spaced apart portions 225 and 227 of the elastic layer by stitching. In particular, second area of attachment 241 and third area of attachment 242 include respective widthwise stitching 248 and 249 that extends through both non-elastic strap 230 and portions 225 and 227 of elastic layer 228, respectively, such that stitching 248 and 249 define where main region 238 begins and where main region 238 ends. In addition, first area of attachment 240 and fourth area of attachment 243 also include widthwise stitching through non-elastic strap 230 and portions 225 and 227 of elastic layer 228, respectively.

Between first area of attachment 240 and second area of attachment 241 is a first governing region or first section 236 of strap assembly 202. In first governing region or first section 236, first portion 225 of the elastic layer has a relaxed length 254 (FIG. 11) and a stretched length 255 (FIG. 12). In first governing region or first section 236, non-elastic webbing strap 230 includes a length 256 (best shown in FIG. 12). Length 256 of non-elastic webbing strap 230 in first section 236 is greater than relaxed length 254 of first portion 225 of the elastic layer in first section 236 and is substantially similar to stretched length 255 of first portion 225 of the elastic layer in the first section 236. In other words, when stretch carry strap assembly 202 is in a relaxed position as is shown in FIG. 11, first governing region or first section 236 includes a gap 258 between first portion 225 of the elastic layer and non-elastic webbing strap 230. When stretch carry strap assembly 202 is in a stretched position as is shown in FIG. 12, non-elastic webbing strap 230 limits how far first portion 225 of the elastic layer stretches in first governing region or first section 236.

Between second area of attachment 241 and third area of attachment 242 of stretch carry strap assembly 202 is main region 238. Main region 238 includes a length 262 of non-elastic webbing strap 230 and terminating ends 221 and 223 of first and second spaced apart portions 225 and 227 of the elastic layer. This is in contrast with the embodiment illustrated in FIGS. 1-10 where the portion of elastic strap 128 and the portion of non-elastic webbing strap 130 in main region 138 are fully attached together and have the substantially same length 160.

Between third area of attachment 242 and fourth area of attachment 243 is a second governing region or third section 237 of strap assembly 202. In second governing region or third section 237, second portion 227 of the elastic layer has a relaxed length 264 (FIG. 11) and a stretched length 265 (FIG. 12). In second governing region or third section 237, non-elastic webbing strap 230 includes a length 266 (shown in FIG. 12). Length 266 of non-elastic webbing strap 230 in third section 237 is greater than relaxed length 264 of second portion 227 of the elastic layer and is substantially similar to stretched length 265 of second portion 227 of the elastic layer. In other words, when stretch carry strap assembly 202 is in a relaxed position as is shown in FIG. 11, second governing region or third section 237 includes a gap 268 between second portion 227 of the elastic layer and non-elastic webbing strap 230. When stretch carry strap assembly 202 is in a stretched position as is shown in FIG. 12, non-elastic webbing strap 230 limits how far second portion 227 of the elastic layer stretches in second governing region or third section 237.

Figure 13:
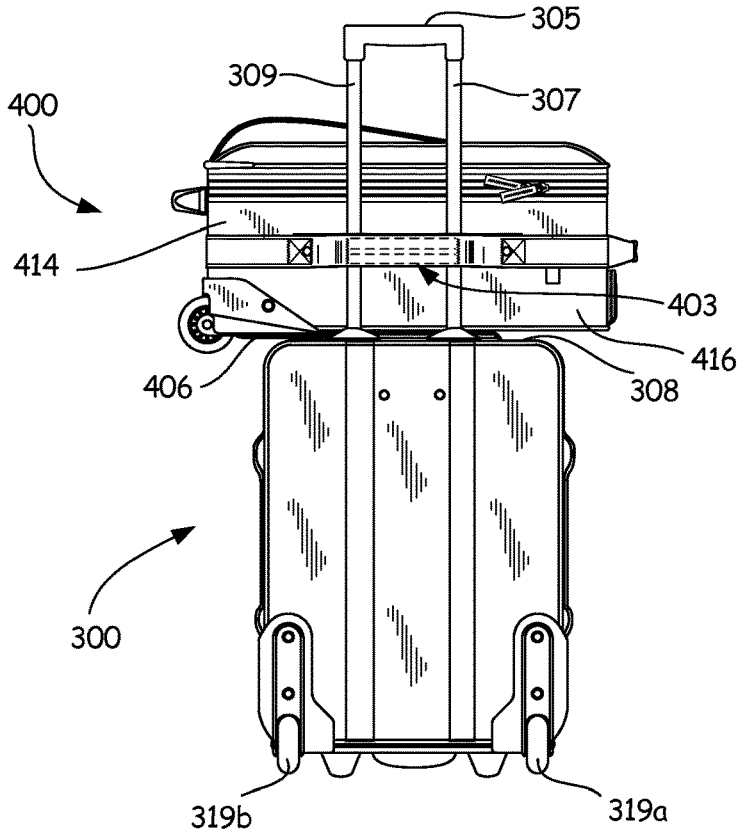
FIG. 13 is a back view of a first bag supporting a second bag using the stretch carry strap assembly located on the second bag to hold the second bag on the first bag.
Figure 14:
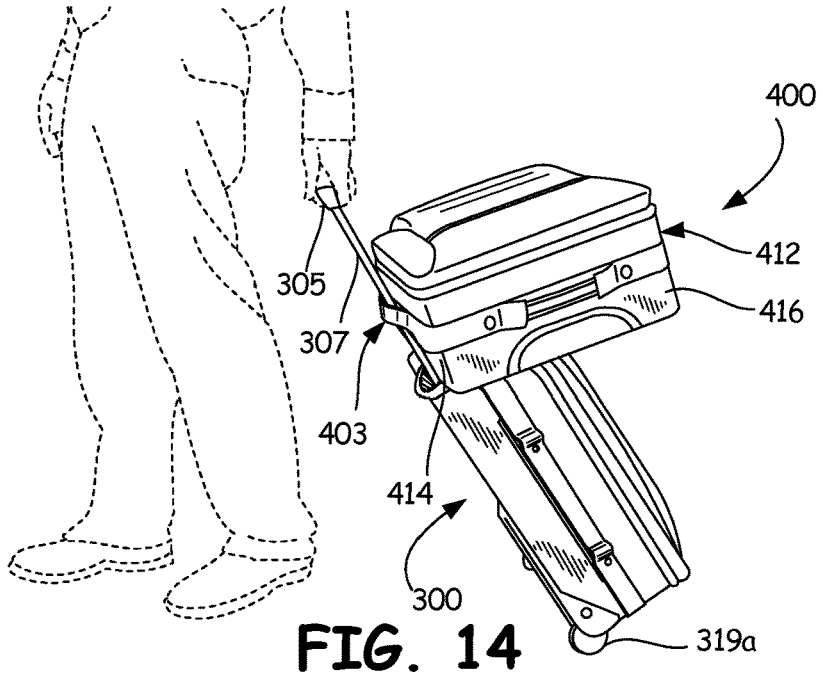
FIG. 14 is a perspective view of the first bag towing the second bag using the stretch carry strap assembly located on the second bag to hold the second bag on the first bag.

FIG. 13 is a back view of a first bag or suitcase 300 supporting a second bag or suitcase 400 using stretch carry strap assembly 403 located on second bag or suitcase 400. In FIG. 13, second bag 400 is similar to bag 100 illustrated in FIGS. 1-7 and stretch carry strap assembly 403 is similar to either stretch carry strap assembly 102 or 103 illustrated in FIGS. 1-10 or stretch carry strap assembly 202 illustrated in FIGS. 11-12. FIG. 14 is a perspective view of first bag 300 towing second bag 400 using stretch carry strap assembly 403 located on second bag 400.

To tow second bag 400 on first bag 300, a telescoping handle 305 on first bag 300 is extended along a pair of telescoping tubes 307 and 309 so that first bag 300 can be wheeled across a floor on wheels 319*a* and 319*b*. It should be realized that bag 300 can have any number of telescoping tubes including a single telescoping tube. Stretch carry strap assembly 403 that is attached to exterior surface 416 of second bag 400 is pulled away from exterior surface 416 from a relaxed position into a stretched position similar to the embodiment illustrated in FIGS. 9 and 10 and in the embodiment illustrated in FIGS. 11 and 12. Stretch carry strap assembly 403 while in the stretched position is slid over and around telescoping tubes 307 and 309 that are connected to telescoping handle 305 on the first bag 300. Stretch carry strap assembly 403 includes a non-elastic strap assembled to an elastic strap such that the non-elastic strap governs how far the elastic strap can be pulled away from exterior surface 416 of second suitcase 400 in the stretched position as is shown in the embodiments illustrated in FIGS. 9-10 and 11-12. Stretch carry strap assembly 403 is released after it is slid over and around telescoping tubes 307 and 309 so that stretch carry strap assembly 403 reverts to a position that is somewhere between the relaxed positions illustrated in FIGS. 9 and 11 and the stretched positions illustrated in FIGS. 10 and 12.

As illustrated in FIG. 14, second bag 400 can then be towed on first bag 300 while a user is pulling first bag 300. In one embodiment and as illustrated in FIGS. 13 and 14, second bag 400 is towed with stretch carry strap assembly 403 that is attached to right side 414 of bag 400. In this configuration, back 406 of bag 400 is resting on top 308 of bag 300 and right side 414 of bag 400 is held to the pair of telescoping tubes 307 and 309 by stretch carry strap assembly 403. In the alternative, second bag 400 can be towed on first bag 300 with a stretch carry strap assembly that is attached to a left side 412 of bag 400. In this configuration, back 406 still rests on top 308 of bag 300, but left side 412 of bag 400 is held to the pair of telescoping tubes 307 and 309 by a different stretch carry strap assembly (not illustrated in FIGS. 13 and 14).

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A bag comprising:

a strap assembly having a first end, a second end, a pair of governing regions and a main region located between each of the pair of governing regions, the strap assembly comprising:

a layer of elastic fabric;

a layer of non-elastic fabric coupled to the layer of elastic fabric;

a first fastener that secures the first end of the strap assembly to an exterior surface of the bag;

a second fastener that secures the second end of the strap assembly to the exterior surface of the bag;

wherein when the strap assembly is in a relaxed position the main region is positioned flush with the exterior surface of the bag and the pair of governing regions include a gap between the layer of elastic fabric and the layer of non-elastic fabric; and wherein when the strap assembly is in a stretched position the main region is spaced apart from the exterior surface of the bag and the layer of non-elastic fabric limits how far the layer of elastic fabric stretches in the pair of governing regions.

2. The bag of claim 1, wherein when the strap assembly is in a relaxed position and when the strap assembly is in the stretched position an entirety of an upper surface of the layer of elastic fabric in the main region of the strap assembly is in contact with an entirety of a lower surface of the layer of non-elastic fabric in the main region of the strap assembly.

3. The bag of claim 1, wherein the layer of elastic fabric comprises a relaxed length and a stretched length and wherein the layer of non-elastic fabric comprises a length, the length of the layer of non-elastic fabric is greater than the relaxed length of the layer of elastic fabric.

4. The bag of claim 1, wherein the layer of elastic fabric located in the main region of the strap assembly comprises a length and wherein the layer of non-elastic fabric located in the main region of the strap assembly comprises a length that is substantially the same as the length of the layer of elastic fabric in the main region.

5. The bag of claim 4, wherein an entirety of the length of the layer of elastic fabric located in the main region of the strap assembly is entirely attached to an entirety of the length of the layer of non-elastic fabric located in main region of the strap assembly.

6. The bag of claim 4, wherein respective portions of the layer of elastic fabric located in each of the pair of governing regions of the strap assembly comprises a relaxed length and a stretched length and wherein respective portions of the layer of non-elastic fabric located in each of the pair of governing regions of the strap assembly comprises a length that is greater than the relaxed length of the respective portions of the layer of elastic fabric located in each of the pair of governing regions.

7. The bag of claim 1, wherein when the strap assembly is in the stretched position the layer of elastic fabric is stretched against the layer of non-elastic fabric.

8. The bag of claim 1, wherein the first fastener comprises a first rivet and the second fastener comprises a second rivet.

9. The bag of claim 1, wherein the layer of elastic fabric comprises two spaced apart portions, the first portion being located in one of the pair of governing regions of the strap assembly and the second portion being located in the other of the pair of governing regions of the strap assembly.

10. A method of towing a second suitcase on a first suitcase, the method comprising:

extending a telescoping handle connected to at least one telescoping tube on the first suitcase so that the first suitcase can be wheeled across a floor;

pulling a stretch carry strap assembly that is attached to an exterior surface of the second suitcase away from the exterior surface of the second suitcase from a relaxed position into a stretched position, wherein the stretch carry strap assembly is attached to the exterior surface of the second suitcase at a first end and a second end of the stretch carry strap assembly;

sliding the stretch carry strap assembly while in the stretched position over and around the at least one telescoping tube connected to the telescoping handle on the first suitcase, wherein the stretch carry strap assembly includes a non-elastic strap assembled to an elastic strap at areas of attachment to form a pair of governing regions located on either side of a main region such that the non-elastic strap governs how far the elastic strap can be pulled away from the exterior surface of the second suitcase in the stretched position, a length of the relaxed elastic strap in the main region being substantially similar to a length of the non-elastic strap in the main region and a length of the relaxed strap in the governing regions being less than a length of the non-elastic strap in the governing regions; and towing the second suitcase on the first suitcase.

11. The method of claim 10, further comprising releasing the stretch carry strap assembly after sliding the stretch carry strap assembly over and around the telescoping tubes of the telescoping handle so that the stretch carry strap assembly reverts to a position between the relaxed position and the stretched position.

12. The method of claim 10, wherein the first suitcase comprises a top, a bottom, a front, a back and a pair of sides and wherein extending the telescoping handle on the first suitcase comprises extending the telescoping handle from the top of the first suitcase.

13. The method of claim 12, wherein the second suitcase comprises a top, a bottom, a front, a back and a pair of sides and wherein the stretch carry strap assembly is located on one of the pair of sides so that when the second suitcase is being towed, the back of second suitcase rests on the top of the first suitcase.

* * * * *